US012472401B2

(12) United States Patent
Choi et al.

(10) Patent No.: US 12,472,401 B2
(45) Date of Patent: Nov. 18, 2025

(54) EXERCISE REHABILITATION SYSTEM USING SMART MIRROR

(71) Applicant: MDA Co., Ltd, Daegu (KR)

(72) Inventors: Jin Wook Choi, Daegu (KR); Kyoung Dong Kim, Daegu (KR)

(73) Assignee: MDA Co., Ltd., Daegu (KR)

( * ) Notice: Subject to any disclaimer, the term of this patent is extended or adjusted under 35 U.S.C. 154(b) by 475 days.

(21) Appl. No.: 18/185,185

(22) Filed: Mar. 16, 2023

(65) Prior Publication Data

US 2023/0364471 A1 Nov. 16, 2023

(30) Foreign Application Priority Data

May 16, 2022 (KR) ..... 10-2022-0059328

(51) Int. Cl.
*A63B 24/00* (2006.01)

(52) U.S. Cl.
CPC ..... *A63B 24/0075* (2013.01); *A63B 24/0062* (2013.01); *A63B 2024/0078* (2013.01); *A63B 2230/62* (2013.01)

(58) Field of Classification Search
CPC ..... A63B 24/0075; A63B 24/0062; A63B 2024/0078; A63B 2230/62
See application file for complete search history.

(56) References Cited

FOREIGN PATENT DOCUMENTS

KR 102120112 B1 6/2020
KR 20210108072 A 9/2021

*Primary Examiner* — Reginald A Renwick
(74) *Attorney, Agent, or Firm* — STIP Law Group, LLC

(57) ABSTRACT

Disclosed is an exercise rehabilitation system using a smart mirror. The exercise rehabilitation system is configured with a rehabilitation exercise motion information database, in which rehabilitation exercise motion information is pre-stored, a user rehabilitation progress information database, in which user rehabilitation progress information is cumulatively stored in real time, a smart mirror device having a display panel that displays rehabilitation exercise coaching information, a touch panel attached to a front surface of the display panel to receive a user's touch input, and a half mirror attached to a front surface of the touch panel to allow the user to view a rehabilitation exercise of the user with naked eyes, and an artificial intelligence (AI) rehabilitation exercise coaching control module that selects the rehabilitation exercise motion information pre-stored in the rehabilitation exercise motion information database on the basis of the user rehabilitation progress information cumulatively stored in the user rehabilitation progress information database using an AI engine, and controls to display the selected rehabilitation exercise motion information and corresponding rehabilitation exercise coaching information on the display panel of the smart mirror device in real time.

1 Claim, 4 Drawing Sheets

EXERCISE REHABILITATION SYSTEM USING SMART MIRROR

CROSS-REFERENCE TO RELATED APPLICATION

This application claims priority to Korean Patent Application No. 10-2022-0059328 filed on May 16, 2022 and all the benefits accruing therefrom under 35 U.S.C. § 119, the contents of which are incorporated by reference in their entirety.

BACKGROUND

The present invention relates to an exercise rehabilitation system, and more particularly, to an exercise rehabilitation system using a smart mirror.

Conventional rehabilitation exercises are generally carried out with the help of rehabilitation therapists in hospitals.

People who require rehabilitation due to a car accident, bone fracture, or the like are confined to a particular space for rehabilitation treatment. People having mobility difficulties are required to regularly visit hospitals or rehabilitation centers, but tend to give up rehabilitation or not visit rehabilitation centers frequently when long-term rehabilitation is required after they have been rehabilitated to a certain degree.

Infrastructure for assisting with rehabilitation exercises anywhere at any time and providing appropriate rehabilitation treatment and guidance has not yet been implemented.

Therefore, a means for providing appropriate rehabilitation treatment guidance according to the progress of rehabilitation exercise is required.

PRIOR ART DOCUMENT

Patent Documents (Patent Document 1) Korean Patent No. 10-2120112

(Patent Document 2) Korean Patent Application Publication No. 10-2021-0108072

SUMMARY

The present disclosure provides an exercise rehabilitation system using a smart mirror.

An exercise rehabilitation system using a smart mirror according to an aspect of the present invention may include a rehabilitation exercise motion information database, in which rehabilitation exercise motion information is pre-stored, a user rehabilitation progress information database, in which user rehabilitation progress information is cumulatively stored in real time, a smart mirror device having a display panel that displays rehabilitation exercise coaching information, a touch panel attached to a front surface of the display panel to receive a user's touch input, and a half mirror attached to a front surface of the touch panel to allow the user to view a rehabilitation exercise of the user with naked eyes, and an artificial intelligence (AI) rehabilitation exercise coaching control module that selects the rehabilitation exercise motion information pre-stored in the rehabilitation exercise motion information database on the basis of the user rehabilitation progress information cumulatively stored in the user rehabilitation progress information database using an AI engine, and controls to display the selected rehabilitation exercise motion information and corresponding rehabilitation exercise coaching information on the display panel of the smart mirror device in real time.

The exercise rehabilitation system may further include: a time of flight (TOF)/stereo camera that generates a 3D image by imaging a user present in front of the smart mirror device; a joint recognition module that recognizes a joint in the 3D image generated by the TOF/stereo camera module; a shoulder height tracking module that tracks a shoulder height of the user according to movement of the user by using the joint recognized by the joint recognition module; a hand direction tracking module that tracks a hand direction of the user according to the movement of the user by using the joint recognized by the joint recognition module; an elbow height tracking module that tracks an elbow height of the user according to the movement of the user by using the joint recognized by the joint recognition module; an arm angle tracking module that tracks an arm angle of the user according to the movement of the user by using the joint recognized by the joint recognition module; a knee height tracking module that tracks a knee height of the user according to a knee height of the user by using the joint recognized by the joint recognition module; a leg angle tracking module that tracks a leg angle of the user according to the knee height of the user by using the joint recognized by the joint recognition module; a waist height tracking module that tracks a waist height of the user according to the knee height of the user by using the joint recognized by the joint recognition module; an ankle height tracking module that tracks an ankle height of the user according to the knee height of the user by using the joint recognized by the joint recognition module; a neck height tracking module that tracks a neck height of the user according to the knee height of the user by using the joint recognized by the joint recognition module; a motion recognition module that recognize a motion of the user by using the shoulder height tracked by the shoulder height tracking module, the hand direction tracked by the hand direction tracking module, the elbow height tracked by the elbow height tracking module, the arm angle tracked by the arm angle tracking module, the knee height tracked by the knee height tracking module, the leg angle tracked by the leg angle tracking module, the waist height tracked by the waist height tracking module, the ankle height tracked by the ankle height tracking module, and the neck height tracked by the neck height tracking module; and an AI rehabilitation exercise evaluation module that evaluates, in real time, the rehabilitation exercise of the user by detecting a motion recognized by the motion recognition module by comparing the rehabilitation exercise motion information and the corresponding rehabilitation exercise coaching information controlled by the AI rehabilitation exercise coaching control module using the AI engine.

The exercise rehabilitation system may further include: a microphone that receives an input of a user voice; a speaker that outputs an AI chatting voice; and an AI voice chatbot module that performs an AI voice chatbot by performing control to recognize the user voice received by the microphone and output an AI voice through the speaker using the AI engine.

The AI voice chatbot module may be configured to perform control to output, as a voice, a real-time evaluation result of the AI rehabilitation exercise evaluation module through the speaker, detect a body state felt by the user during the rehabilitation exercise through the user voice recognized by the AI voice chatbot module, and feed the detected body state back to the AI rehabilitation exercise evaluation module.

The exercise rehabilitation system may further include: a user information database, in which user information is registered; a user face recognition module that recognizes a user face using the 3D image generated by the TOF/stereo camera module; a user information registration module that registers the user information in the user information database using the user face recognized by the user face recognition module; and a user identification module that identifies the user by comparing the user face recognized by the user face recognition module and the user information pre-registered in the user information database.

The AI rehabilitation exercise coaching module may be configured to control rehabilitation exercise coaching according to the user identified by the user identification module.

The exercise rehabilitation system may further include: a user position/distance detection module that detects a distance and position of the user relative to the smart mirror device using the 3D image generated by the TOF/stereo camera module; a user mirror image estimation module that estimates a user mirror image on the half mirror on the basis of the position and distance detected by the user position/distance detection module; a user 3D image simulation module that uses the 3D image generated by the TOF/stereo camera module to simulate and display a user 3D image on the display panel; a mirror image/3D image synchronization module that synchronizes the user 3D image displayed on the display panel by the user 3D image simulation module with the user mirror image on the half mirror estimated by the user mirror image estimation module; and a user mirror image-based rehabilitation motion guide module that guides a rehabilitation motion by reflecting the rehabilitation exercise motion information controlled by the AI rehabilitation exercise coaching control module in the user 3D image displayed by the mirror image/3D image synchronization module.

The exercise rehabilitation system may further include a smart mirror device automatic rotation driving module that automatically rotates the smart mirror device to a horizontal screen state or vertical screen state according to a posture of the user mirror image on the half mirror estimated by the user mirror image estimation module.

BRIEF DESCRIPTION OF THE DRAWINGS

Exemplary embodiments can be understood in more detail from the following description taken in conjunction with the accompanying drawings, in which.

DETAILED DESCRIPTION OF EMBODIMENTS

Figure 1:
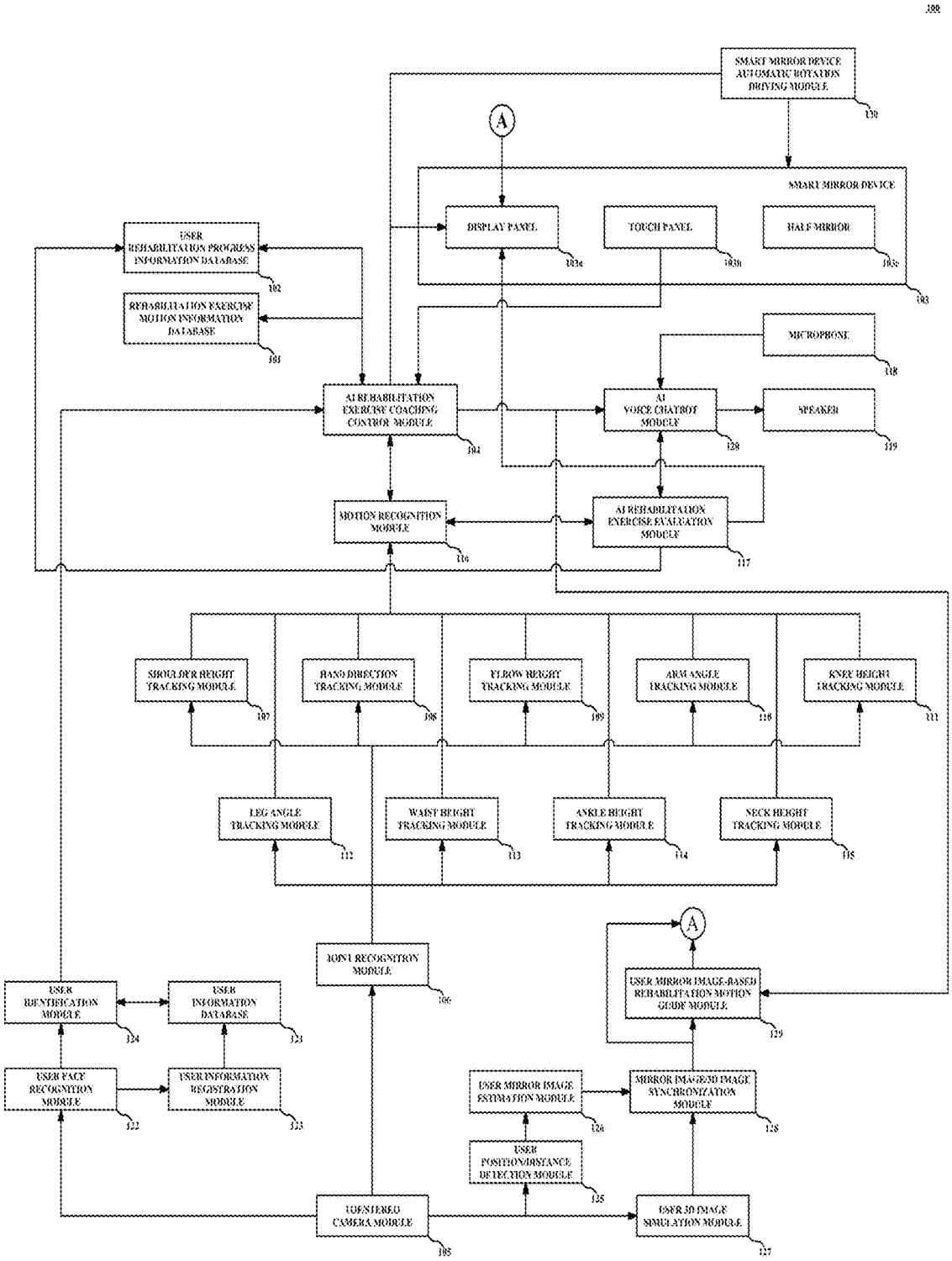
FIG. 1 is a block diagram illustrating an exercise rehabilitation system using a smart mirror according to an embodiment of the present invention.

The present invention may be variously modified and may include various embodiments. However, particular embodiments are exemplarily illustrated in the drawings and will be described in detail in the detailed description for carrying out the invention. However, it should be understood that the particular embodiments are not intended to limit the present disclosure to specific forms, but rather the present disclosure is meant to cover all modification, similarities, and alternatives which are included in the spirit and scope of the present disclosure. Like reference numerals refer to like elements throughout.

Relational terms such as first, second, A, B, and the like may be used for describing various elements, but the elements should not be limited by the terms. Such terms are only used for distinguishing one element from other elements. For example, a first element could be termed a second element and vice versa without departing from the scope of the right of the present invention. The term "and/or" encompasses both combinations of the plurality of related items disclosed and any item from among the plurality of related items disclosed.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

The terminology used herein is not for delimiting the present invention but for describing the specific embodiments. The terms of a singular form may include plural forms unless otherwise specified. It will be further understood that the terms "comprise", "comprising,", "include", "including", "have" and/or "having", when used herein, specify the presence of stated features, numbers, steps, operations, elements, components or combinations thereof, but do not preclude the presence or addition of one or more other features, numbers, steps, operations, elements, components or combinations thereof.

The terms used herein, including technical or scientific terms, have the same meanings as understood by those skilled in the art. Terms in common usage such as those defined in commonly used dictionaries should be interpreted as is customary in the relevant art, but should not be interpreted in an idealized or overly formal sense unless otherwise defined herein.

Hereinafter, example embodiments of the present invention will be described in detail with reference to the accompanying drawings.

Figure 2:
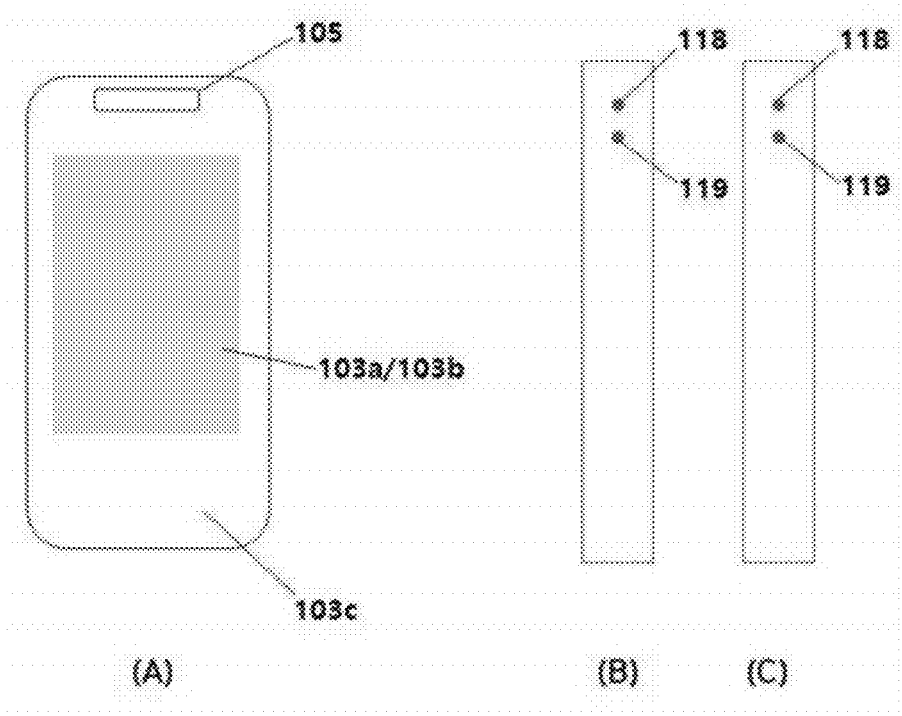
FIG. 2 is a front view and left/right side views of a smart mirror device according to an embodiment of the present invention.
Figure 3:
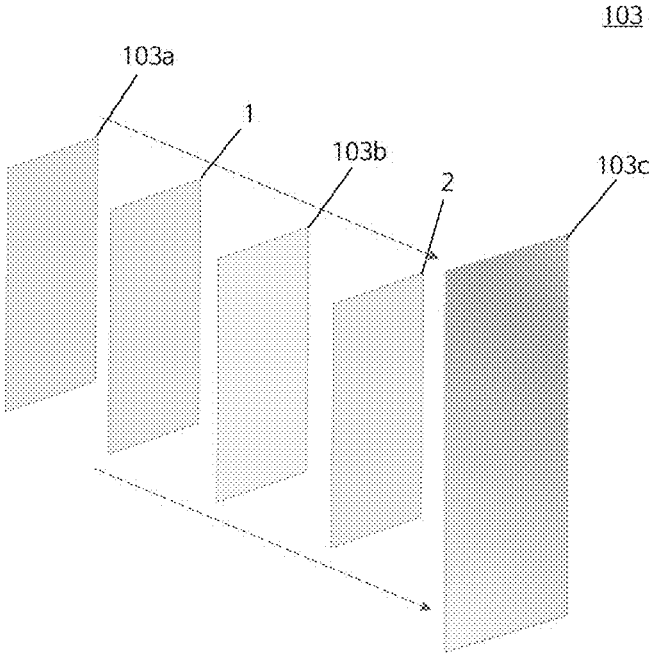
FIG. 3 is a hierarchy diagram illustrating a panel of a smart mirror device according to an embodiment of the present invention.
Figure 4:
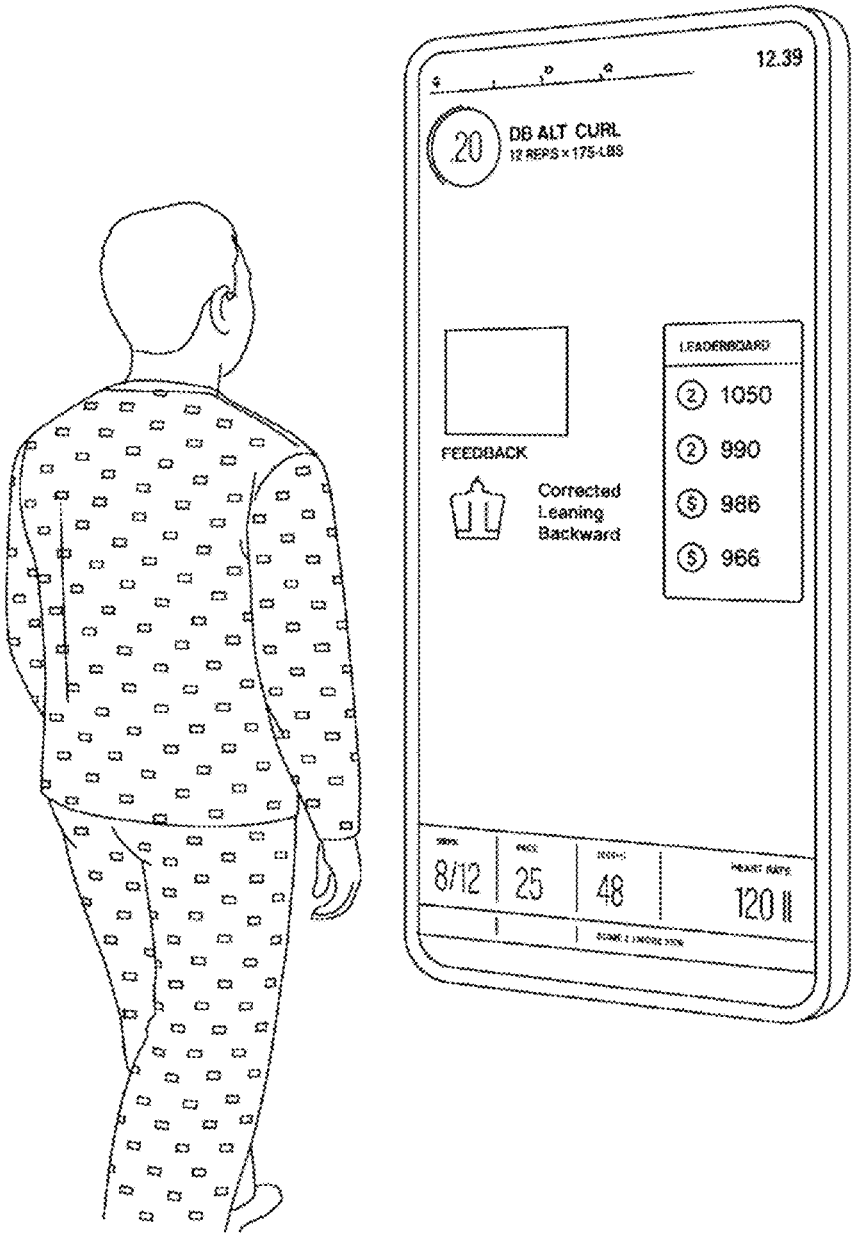
FIG. 4 is a diagram illustrating an example of usage according to an embodiment of the present invention.
Figure 5:
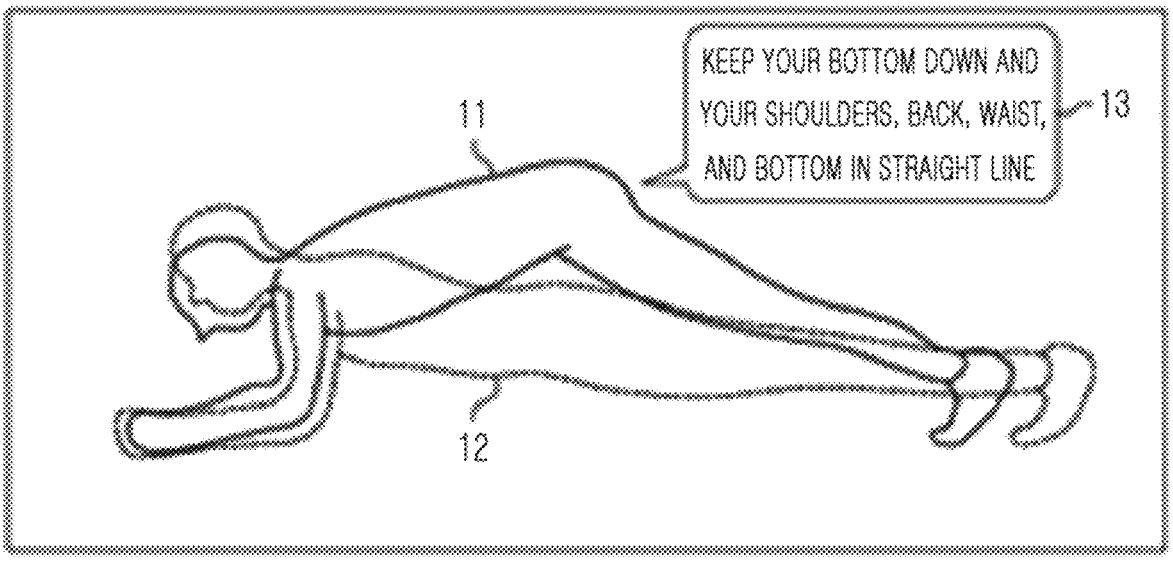
FIG. 5 is a diagram illustrating an example of a screen pertaining to rehabilitation exercise guidance according to an embodiment of the present invention.

FIG. 1 is a block diagram illustrating an exercise rehabilitation system using a smart mirror according to an embodiment of the present invention, and FIG. 2 is a front view and left/right side views of a smart mirror device according to an embodiment of the present invention. FIG. 3 is a hierarchy diagram illustrating a panel of a smart mirror device according to an embodiment of the present invention, FIG. 4 is a diagram illustrating an example of usage according to an embodiment of the present invention, and FIG. 5 is a diagram illustrating an example of a screen pertaining to rehabilitation exercise guidance according to an embodiment of the present invention.

Referring to FIG. 1, an exercise rehabilitation system 100 using a smart mirror according to an embodiment of the present invention may include a rehabilitation exercise motion information database 101, a user rehabilitation progress information database 102, a smart mirror device 103, an artificial intelligence (AI) rehabilitation exercise coaching control module 104, a time of flight (TOF)/stereo camera module 105, a joint recognition module 106, a shoulder height tracking module 107, a hand direction tracking module 108, an elbow height tracking module 109, an arm angle tracking module 110, a knee height tracking module 111, a leg angle tracking module 112, a waist height tracking module 113, an ankle height tracking module 114, a neck height tracking module 115, a motion recognition module 116, an AI rehabilitation exercise evaluation module 117, a microphone 118, a speaker 119, an AI voice chatbot module 120, a user information database 121, a user face recognition module 122, a user information registration module 123, a user identification module 124, a user position/distance detection module 125, a user mirror image estimation module 126, a user 3D image simulation module 127, a mirror image/3D image synchronization module 128, a user mirror image-based rehabilitation motion guide module 129, and a smart mirror device automatic rotation driving module 130.

Hereinafter, a detailed configuration will be described.

The rehabilitation exercise motion information database 101 may be configured to store rehabilitation exercise motion information in advance. The rehabilitation exercise motion information may include an image, video, and specific action information about various rehabilitation exercise motions for body rehabilitation of a user. For example, the rehabilitation exercise motion information may include information about various rehabilitation motions such as a knee lifting action, a finger spreading action, etc.

The user rehabilitation progress information database 102 may be configured to cumulatively store user rehabilitation progress information in real time. The user rehabilitation progress information may include a record and rehabilitation progress state related to a rehabilitation exercise of the user, a degree of recovery by rehabilitation, etc.

The smart mirror device 103 may include a display panel 103*a*, a touch panel 103*b*, and a half mirror 103. Referring to FIGS. 2 and 3, the smart mirror device 103 may be configured in a form in which the display panel 103*a*, the touch panel 103*b*, and the half mirror 103*c* are bonded by adhesives 1 and 2 and stacked.

The display panel 103*a* may be configured to display rehabilitation exercise coaching information. The display panel 103*a* may include a liquid crystal display (LCD) or an organic light-emitting diode (OLED), and may be configured to output feedback to a user's rehabilitation exercise, a rehabilitation exercise motion, etc. as the rehabilitation exercise coaching information.

The touch panel 103*b* may be attached to a front surface of the display panel 103*a* and configured to receive a touch input from the user. The user may input commands such as rehabilitation exercise selection or stop, rehabilitation exercise history check, etc. through the touch input.

The half mirror 103*c* may be attached to a front surface of the touch panel 103*b* and configured to allow the user to view a rehabilitation exercise of the user with naked eyes. The half mirror 103*c* may be configured so that light is transmitted only in one side direction and reflected in the other side direction. Accordingly, the user may check a rehabilitation motion of the user in front of the half mirror 103*c*, and may also check the rehabilitation exercise coaching information output through the display panel 103*a*. As shown in FIG. 4, the user may simultaneously check the rehabilitation motion and the rehabilitation exercise coaching information from one screen, and thus may feel convenience and easily recognize a problem of the rehabilitation motion of the user.

The AI rehabilitation exercise coaching control module 104 may be configured to automatically select rehabilitation exercise motion information pre-stored in the rehabilitation exercise motion information database 101 on the basis of the user rehabilitation progress information cumulatively stored in the user rehabilitation progress information database 102 using an AI engine. Since the rehabilitation exercise motion information is selected on the basis of existing user rehabilitation progress information, optimal rehabilitation exercise motion information may be selected according to how much a user's body has recovered.

The AI rehabilitation exercise coaching control module 104 may perform control to display the selected rehabilitation exercise motion information and the corresponding rehabilitation exercise coaching information on the display panel 103*a* of the smart mirror device 103 in real time. The rehabilitation exercise coaching information may include feedback information about how to correct a motion according to accuracy of a current motion of the user.

The TOF/stereo camera module 105 may be configured to generate a 3D image by imaging the user present in front of the smart mirror device 103. The TOF/stereo camera module 105 is configured to detect depth information or distance information of a front object according to a degree of accumulation of reflected light in an in-phase interval and out-phase interval. The TOF/stereo camera module 105 may detect a distance and three-dimensional shape of the user to some extent. As shown in FIG. 2, the TOF/stereo camera module 105 may be provided at an upper end of the smart mirror device 103, and may be additionally and separately installed on a left side, right side, and rear of the user.

The joint recognition module 106 may be configured to recognize a joint in a 3D image generated by the TOF/stereo camera module 105. A joint may be recognized using various image recognition algorithms.

The shoulder height tracking module 107 may be configured to track a shoulder height of the user according to movement of the user by using a joint recognized by the joint recognition module 106.

The hand direction tracking module 108 may be configured to track a hand direction of the user according to movement of the user by using a joint recognized by the joint recognition module 106.

The elbow height tracking module 109 may be configured to track an elbow height of the user according to movement of the user by using a joint recognized by the joint recognition module 106.

The arm angle tracking module 110 may be configured to track an arm angle of the user according to movement of the user by using a joint recognized by the joint recognition module 106.

The knee height tracking module 111 may be configured to track a knee height of the user according to a knee height of the user by using a joint recognized by the joint recognition module 106.

The leg angle tracking module 112 may be configured to track a leg angle of the user according to the knee height of the user by using a joint recognized by the joint recognition module 106.

The waist height tracking module 113 may be configured to track a waist height of the user according to the knee height of the user by using a joint recognized by the joint recognition module 106.

The ankle height tracking module 114 may be configured to track an ankle height of the user according to the knee height of the user by using a joint recognized by the joint recognition module 106.

The neck height tracking module 115 may be configured to track a neck height of the user according to the knee height of the user by using a joint recognized by the joint recognition module 106.

The motion recognition module 116 may be configured to recognize a motion of the user by using the shoulder height tracked by the shoulder height tracking module 107, the hand direction tracked by the hand direction tracking module 108, the elbow height tracked by the elbow height tracking module 109, the arm angle tracked by the arm angle tracking module 110, the knee height tracked by the knee height tracking module 111, the leg angle tracked by the leg angle tracking module 112, the waist height tracked by the waist height tracking module 113, the ankle height tracked by the ankle height tracking module 114, and the neck height tracked by the neck height tracking module 115. Here, the shoulder height, the hand direction, the elbow height, the arm angle, etc. may be import factors for recognizing a rehabilitation motion.

The AI rehabilitation exercise evaluation module 117 may be configured to evaluate, in real time, a user's rehabilitation exercise by detecting a motion recognized by the motion recognition module 116 by comparing the rehabilitation exercise motion information and the corresponding rehabilitation exercise coaching information controlled by the AI rehabilitation exercise coaching control module 104 using an AI engine. That is, the AI rehabilitation exercise evaluation module 117 may be configured to evaluate whether the user is making a correct motion according to the rehabilitation exercise motion information.

The microphone 118 may be configured to receive an input of a user voice. The user voice may be a voice command. Furthermore, a state of pain during rehabilitation of the user may be input in real time through the microphone 118. The state of pain may be input through a moaning sound of the user or predetermined words such as "it hurts", "stiff", etc.

The speaker 119 may be configured to output an AI chatting voice.

The AI voice chatbot module 120 may be configured to perform an AI voice chatbot by performing control to recognize a user voice received through the microphone 118 and output an AI voice through the speaker 119 using an AI engine.

Here, the AI voice chatbot module 120 may be configured to perform control to output, as a voice, a real-time evaluation result of the AI rehabilitation exercise evaluation module 117 through the speaker 119. For example, the AI voice chatbot module 120 may be configured to output a real-time evaluation result such as "raise your bottom higher" or "bend your knees more".

The AI voice chatbot module 120 may be configured to detect a body state felt by the user during a rehabilitation exercise through a user voice recognized by the AI voice chatbot module 120 and feed the detected body state back to the AI rehabilitation exercise evaluation module 117. For example, when the user utters various body states such as "it hurts", "stiff", "I have no feeling", "my knees won't bend anymore", etc. in real time, the AI voice chatbot module 120 may recognize a body state felt by the user during a particular motion and feed this body state back to the AI rehabilitation exercise evaluation module 117. The AI rehabilitation exercise evaluation module 117 may recognize a body state felt by the user during a particular motion, and, in this manner, may detect and evaluate a body state of the user. This may be important data for determining a rehabilitation exercise to be recommended according to a body state of the user. Furthermore, the AI rehabilitation exercise coaching control module 104 may be automatically set to gradually increase intensity of a rehabilitation exercise.

The user information database 121 may be configured to register user information.

The user face recognition module 122 may be configured to recognize a user face using a 3D image generated by the TOF/stereo camera module 105.

The user information registration module 123 may be configured to register user information in the user information database 121 using a user face recognized by the user face recognition module 122. The user information registration module 123 may receive an input of not only a user face but also height information.

The user identification module 124 may be configured to identify the user by comparing a user face recognized by the user face recognition module 122 and user information pre-registered in the user information database 121. The user may be automatically identified through a user face recognized through a 3D image without undergoing additional log-in.

Here, the AI rehabilitation exercise coaching control module 104 may be configured to control rehabilitation exercise coaching according to the user identified by the user identification module 124. The AI rehabilitation exercise coaching control module 104 may be configured to perform optimal rehabilitation exercise coaching on the basis of a current body state or rehabilitation history of the user, and perform coaching about a specific action according to accuracy of a current motion.

The user position/distance detection module 125 may be configured to detect a distance and position of the user relative to the smart mirror device 103 using a 3D image generated by the TOF/stereo camera module 105.

The user mirror image estimation module 126 may be configured to estimate a user mirror image on the half mirror 103*c* on the basis of a position and distance detected by the user position/distance detection module 125. Here, the user mirror image is a user's image viewed by the user through the half mirror 103*c* with naked eyes, and the user mirror image estimation module 126 may estimate a size and shape of the user shown on the half mirror 103*c*. In detail, the user mirror image estimation module 126 may estimate a size and shape of the user mirror image on the half mirror 103*c* by using height information among the user information and distance information obtained using a 3D image.

The user 3D image simulation module 127 may be configured to use a 3D image generated by the TOF/stereo camera module 105 to simulate and display a user 3D image on the display panel 103*a*. The TOF/stereo camera module 105 may be provided in plurality as described above, and may use the 3D image to simulate and display the user 3D image on the display panel 103*a*.

The mirror image/3D image synchronization module 128 may be configured to synchronize the user 3D image displayed on the display panel 103*a* by the user 3D image simulation module 127 with the user mirror image on the half mirror 103*c* estimated by the user mirror image estimation module 126. That is, the mirror image/3D image synchronization module 128 may display the user 3D image so that the user 3D image is superimposed on a contour of the user mirror image, and thus each time the user makes a motion, the user 3D image with the motion may be displayed superimposed on the user mirror image in the same size as and in synchronization with the user mirror image.

The user mirror image-based rehabilitation motion guide module 129 may be configured to guide a rehabilitation motion by reflecting the rehabilitation exercise motion information controlled by the AI rehabilitation exercise coaching control module 104 in the user 3D image displayed by the mirror image/3D image synchronization module 128. That is, when the user 3D image makes a motion according to the rehabilitation exercise motion information, the user may follow the motion and check the motion of the user through the user mirror image. The user may check accuracy of the motion of the user according to whether the user mirror image is viewed in accordance with the user 3D image. FIG. 5 illustrates an example in which a user mirror image 11 and a user 3D image 12 are displayed in synchronization with each other. In an actual motion of the user, the bottom of the user is in a raised posture, and the AI rehabilitation exercise evaluation module 117 may identify this posture and evaluate a rehabilitation exercise state, and the AI rehabilitation exercise coaching control module 104 may perform control to output feedback 13 such as "keep your bottom down and your shoulders, back, waist, and bottom in a straight line" in real time.

The smart mirror device automatic rotation driving module 130 may be configured to automatically rotate the smart mirror device 103 to a horizontal screen state or vertical screen state according to a posture of the user mirror image on the half mirror 103*c* estimated by the user mirror image estimation module 126. The user's body may be only partially shown on a vertical screen when the user is in a prone position as illustrated in FIG. 5, and the smart mirror device automatic rotation driving module 130 may be configured to automatically rotate the screen of the smart mirror device 103 to a horizontal screen state. That is, the smart mirror device automatic rotation driving module 130 may automatically rotationally drive to a horizontal screen state or vertical screen state according to a current rehabilitation motion.

According to the above-mentioned exercise rehabilitation system using a smart mirror, a rehabilitation exercise guidance is output through a display panel, and a user may perform a rehabilitation exercise while checking a rehabilitation motion of the user through a half mirror arranged so as to be stacked on the display panel, and thus the user may frequently perform a rehabilitation exercise anywhere at any time, and may continue a rehabilitation exercise over a long period of time without direct help of a rehabilitation therapist.

In particular, since the progress of rehabilitation of the user is detected by virtue of an AI engine, and a rehabilitation exercise guidance optimized for the progress of rehabilitation is provided, the effect of a rehabilitation exercise may be maximized.

Furthermore, since an image of the user shown on the half mirror is estimated using a TOF camera, and a 3D image of the user is output and displayed so as to be superimposed on the half mirror image of the user in synchronization with the half mirror image of the user, the user may correctly recognize a wrong posture during a rehabilitation exercise. That is, the user may receive rehabilitation coaching feedback without direct help of a rehabilitation therapist.

Meanwhile, since the smart mirror device is automatically rotated to a horizontal screen or vertical screen according to a posture of a rehabilitation exercise, the user's body may be fully displayed on the screen even when the posture of a rehabilitation exercise changes.

Although the present invention has been described with reference to the embodiments, it will be readily understood by those skilled in the art that various modifications and changes can be made thereto without departing from the spirit and scope of the present invention defined by the appended claims.

What is claimed is:

1. An exercise rehabilitation system using a smart mirror, the exercise rehabilitation system comprising:

a rehabilitation exercise motion information database, in which rehabilitation exercise motion information is pre-stored;

a user rehabilitation progress information database, in which user rehabilitation progress information is cumulatively stored in real time;

a smart mirror device having a display panel that displays rehabilitation exercise coaching information, a touch panel attached to a front surface of the display panel to receive a user's touch input, and a half mirror attached to a front surface of the touch panel to allow the user to view a rehabilitation exercise of the user with naked eyes; and an artificial intelligence (AI) rehabilitation exercise coaching control module that selects the rehabilitation exercise motion information pre-stored in the rehabilitation exercise motion information database on the basis of the user rehabilitation progress information cumulatively stored in the user rehabilitation progress information database using an AI engine, and controls to display the selected rehabilitation exercise motion information and corresponding rehabilitation exercise coaching information on the display panel of the smart mirror device in real time, the exercise rehabilitation system further comprising:

a time of flight (TOF)/stereo camera that generates a 3D image by imaging a user present in front of the smart mirror device;

a joint recognition module that recognizes a joint in the 3D image generated by the TOF/stereo camera module;

a shoulder height tracking module that tracks a shoulder height of the user according to movement of the user by using the joint recognized by the joint recognition module;

a hand direction tracking module that tracks a hand direction of the user according to the movement of the user by using the joint recognized by the joint recognition module;

an elbow height tracking module that tracks an elbow height of the user according to the movement of the user by using the joint recognized by the joint recognition module;

an arm angle tracking module that tracks an arm angle of the user according to the movement of the user by using the joint recognized by the joint recognition module;

a knee height tracking module that tracks a knee height of the user according to a knee height of the user by using the joint recognized by the joint recognition module;

a leg angle tracking module that tracks a leg angle of the user according to the knee height of the user by using the joint recognized by the joint recognition module;

a waist height tracking module that tracks a waist height of the user according to the knee height of the user by using the joint recognized by the joint recognition module;

an ankle height tracking module that tracks an ankle height of the user according to the knee height of the user by using the joint recognized by the joint recognition module;

a neck height tracking module that tracks a neck height of the user according to the knee height of the user by using the joint recognized by the joint recognition module;

a motion recognition module that recognize a motion of the user by using the shoulder height tracked by the shoulder height tracking module, the hand direction tracked by the hand direction tracking module, the elbow height tracked by the elbow height tracking module, the arm angle tracked by the arm angle tracking module, the knee height tracked by the knee height tracking module, the leg angle tracked by the leg angle tracking module, the waist height tracked by the waist height tracking module, the ankle height tracked by the ankle height tracking module, and the neck height tracked by the neck height tracking module; and an AI rehabilitation exercise evaluation module that evaluates, in real time, the rehabilitation exercise of the user by detecting a motion recognized by the motion recognition module by comparing the rehabilitation exercise motion information and the corresponding rehabilitation exercise coaching information controlled by the AI rehabilitation exercise coaching control module using the AI engine, the exercise rehabilitation system further comprising:

a microphone that receives an input of a user voice;

a speaker that outputs an AI chatting voice; and an AI voice chatbot module that performs an AI voice chatbot by performing control to recognize the user voice received by the microphone and output an AI voice through the speaker using the AI engine, wherein the AI voice chatbot module is configured to perform control to output, as a voice, a real-time evaluation result of the AI rehabilitation exercise evaluation module through the speaker, detect a body state felt by the user during the rehabilitation exercise through the user voice recognized by the AI voice chatbot module, and feed the detected body state back to the AI rehabilitation exercise evaluation module, the exercise rehabilitation system further comprising:

a user information database, in which user information is registered;

a user face recognition module that recognizes a user face using the 3D image generated by the TOF/stereo camera module;

a user information registration module that registers the user information in the user information database using the user face recognized by the user face recognition module; and a user identification module that identifies the user by comparing the user face recognized by the user face recognition module and the user information pre-registered in the user information database;

wherein the AI rehabilitation exercise coaching module is configured to control rehabilitation exercise coaching according to the user identified by the user identification module, the exercise rehabilitation system further comprising:

a user position/distance detection module that detects a distance and position of the user relative to the smart mirror device using the 3D image generated by the TOF/stereo camera module;

a user mirror image estimation module that estimates a user mirror image on the half mirror on the basis of the position and distance detected by the user position/distance detection module;

a user 3D image simulation module that uses the 3D image generated by the TOF/stereo camera module to simulate and display a user 3D image on the display panel;

a mirror image/3D image synchronization module that synchronizes the user 3D image displayed on the display panel by the user 3D image simulation module with the user mirror image on the half mirror estimated by the user mirror image estimation module;

a user mirror image-based rehabilitation motion guide module that guides a rehabilitation motion by reflecting the rehabilitation exercise motion information controlled by the AI rehabilitation exercise coaching control module in the user 3D image displayed by the mirror image/3D image synchronization module; and a smart mirror device automatic rotation driving module that automatically rotates the smart mirror device to a horizontal screen state or vertical screen state according to a posture of the user mirror image on the half mirror estimated by the user mirror image estimation module, wherein the rehabilitation exercise motion information includes an image, video, and action information about a rehabilitation exercise motion for body rehabilitation of the user, the user rehabilitation progress information includes a record and rehabilitation progress state related to the rehabilitation exercise of the user and a degree of recovery by rehabilitation, and a rehabilitation exercise selection command, rehabilitation exercise stop command, or rehabilitation exercise history check command is input to the AI rehabilitation exercise coaching control module through a touch input to the touch panel.

* * * * *